US007658804B1

(12) United States Patent
Cano

(10) Patent No.: US 7,658,804 B1
(45) Date of Patent: Feb. 9, 2010

(54) DUCT BRUSH AND DUCT CLEANING SYSTEM

(76) Inventor: Jose Cano, 1926 SW. Notre Dame Ave., Port St. Lucie, FL (US) 34953

( * ) Notice: Subject to any disclaimer, the term of this patent is extended or adjusted under 35 U.S.C. 154(b) by 659 days.

(21) Appl. No.: 11/403,798

(22) Filed: Apr. 13, 2006

Related U.S. Application Data

(60) Provisional application No. 60/671,987, filed on Apr. 18, 2005.

(51) Int. Cl.
*B08B 9/04* (2006.01)

(52) U.S. Cl. ..... 134/8; 15/304; 15/387; 15/406

(58) Field of Classification Search ..... None
See application file for complete search history.

(56) References Cited

U.S. PATENT DOCUMENTS

| | | | | | |
|---|---|---|---|---|---|
| 3,882,566 | A | | 5/1975 | Hubbell | 15/104.3 R |
| 3,994,310 | A | | 11/1976 | Brandon | 134/167 C |
| 4,656,685 | A | | 4/1987 | Wood | 15/104.16 |
| 4,984,329 | A | | 1/1991 | Wade | 15/387 |
| 5,020,188 | A | | 6/1991 | Walton | 15/406 |
| 5,364,473 | A | * | 11/1994 | Van Der Does | 134/8 |
| 5,369,834 | A | | 12/1994 | Groen | 15/104.095 |
| 5,383,243 | A | | 1/1995 | Thacker | 15/104.18 |
| 5,535,478 | A | | 7/1996 | Thompson | 15/401 |
| 5,560,069 | A | | 10/1996 | Berger | 15/160 |
| 5,819,354 | A | | 10/1998 | Alonso | 15/104.05 |
| 5,868,858 | A | * | 2/1999 | Creed | 134/8 |
| 5,904,160 | A | | 5/1999 | Wright | 134/21 |
| 6,135,129 | A | * | 10/2000 | Akazawa | 134/8 |
| 6,481,047 | B1 | | 11/2002 | Schaefer | 15/314 |

OTHER PUBLICATIONS

Vent Brush; Harriet Carter catalog; Fall 2004; p. 82.
Clothes Dryer Lint Brush; Carol Wright Gifts catalog; Fall 2004; p. 47.
Flexi-Hose Vac Attachment; Improvements Catalog; Fall 2005; p. 51.

* cited by examiner

*Primary Examiner*—Duy-Vu N Deo
(74) *Attorney, Agent, or Firm*—William L. Muckelroy; Art Lessler; Gary Lipson

(57) ABSTRACT

A duct cleaning apparatus and method for cleaning and maintaining the interior of most types of ducts, including chimneys, air conditioning and heating ducts, dryer ducts, vents, plumbing and rain gutter ducts. The apparatus is made up of a flexible rope (24) connected to a cleaning brush (10) or tool further connected to a retrieval parachute (30). The flexible rope (24) can be extended through the use of additional attached ropes (26) to create an infinitely long cleaning apparatus. The cleaning brush (10) may be configured in a variety of sizes with differing configurations of bristles (14) or appendages for specific applications. The cleaning appendages are connected to a rope (24) or line B, the length of which extends beyond the length of the duct (12) to be cleaned. One end of the rope (24) or line A is connected to the parachute (30) adapted with a wind-expanded periphery greater than that of the perimeter of the inside wall (22) of the duct (12) to be cleaned. A method is described for preparing the duct (12) for cleaning with the brush (10) by threading a rope or line A through the duct (12) using the parachute (30) and applying a vacuum from a machine (36).

13 Claims, 3 Drawing Sheets

DUCT BRUSH AND DUCT CLEANING SYSTEM

PRIORITY DATE CLAIM

A priority date of Apr. 18, 2005 is claimed based on a filed related provisional patent application in the United States Patent Office, Ser. No. 60/671,987, on Apr. 18, 2005 disclosing the subject matter of the invention claimed herein.

BACKGROUND OF THE INVENTION

1. Field of the Invention

This invention relates generally to the cleaning of ducting and vent pipes and more particularly to an apparatus and method for cleaning ducting that uses any specifically configured brush connected to a rope that is detachably connected to a retrieval and deployment parachute. The brush must fit snugly into the duct and the parachute must have a deployed diameter sufficient to transit the duct with a rope attached.

2. Description of the Prior Art

Devices for cleaning ducts are well known in the art. Recent catalog items include (a) a long, flat, Flexi-Hose™ designed to let one use a vacuum to clean deep down into a lint trap of a clothes dryer; and, (b) a four inch circular vent brush with a 10 foot long flexible handle to help a person clean dryer vent tubes and pipes part way to prevent dryer vent fires from lint that accumulates inside a dryer vent over time.

In 2002 Schaefer was issued U.S. Pat. No. 6,481,047 for a lint vacuum cleaner device for cleaning lint from lint traps of clothes dryers. In 1999 Wright received U.S. Pat. No. 5,904,160 for a method of removing lint from clothes dryers using a magnetically mountable hand held vacuum cleaner. In U.S. Pat. No. 5,819,354 Alonso et al invented an apparatus and method for cleaning and maintaining the interior dryer ducts. The apparatus is made up of a flexible shaft connected to a cleaning brush or tool. The flexible shaft is extended thru the duct using attached couplings that fit inside the duct to create a cleaning apparatus as long as needed, to extend throughout the length of the duct.

In July of 1996 Thompson received U.S. Pat. No. 5,535,478 for a suction wand attachment and scraping nozzle for vacuuming lint from dryers. Also in October of 1996, Berger et al received U.S. Pat. No. 5,560,069 for a uniquely configured lint cleaning brush for removing lint from an arcuate exhaust duct of a clothes dryer.

In 1995 Thacker et al according to U.S. Pat. No. 5,383,243 employed an umbrella shaped brush connected to a plunger controlled by an operator at the end of what may be a segmented suction hose. However, Groen et al in 1994 used a compressed air powered rotary driven duct cleaning brush with flexible overtly extended bristles for cleaning rectangular cross-section ducts according to U.S. Pat. No. 5,369,834.

Other prior art includes U.S. Pat. No. 5,020,188 that discloses a device which fits inside the ductwork and discharges cleaning fluids under pressure onto the duct walls. This apparatus creates a considerable amount of fluid which must be evacuated by a vacuum exhaust pump.

The device disclosed in U.S. Pat. No. 4,984,329 contains an outer hose, an inner hose, a turbine, and a brush. Thus, this apparatus is expensive to manufacture because of its many parts. The device disclosed in U.S. Pat. No. 4,656,685 contains a hose, a brush, a nozzle for dispensing cleaning fluids onto the duct walls, and a sponge. Here, again, large quantities of cleaning fluids must be disposed of, making the cleaning process awkward and time-consuming. The duct cleaning device disclosed in U.S. Pat. No. 3,994,310 contains two jets for loosening and removing debris attached to the duct. This device is complicated in its manufacture and requires the removal of large amounts of dirty fluid in the process of cleaning the ductwork.

U.S. Pat. No. 3,882,566 discloses a method of cleaning ducts by dragging a cleaning element through the ductwork by means of a dragline. This method employs a plurality of cleaning elements of varying sizes.

Devices having a shaft connected to a body configured with cleaning elements have long been used for cleaning internal tubes, ducts and chimneys. These devices are typically rotated as they are moved inside the tube, duct, or chimney, to be cleaned. However, differing types and uses of ducts have made these devices less desirable and in some situations unusable.

For example, recent advances in air conditioning and heating ducting, as well as other ducting systems, have led to the use of smaller diameter ducting as well as ducting with a thinner wall thickness. Since these ducts have smaller passageways than previous ducting, there is an increase in the chance of dirt and dust buildup, as well as an increased chance of becoming blocked. Further, since these ducts have thinner walls and are thus typically weaker, older cleaning devices may actually damage the ducts rather than clean. Thus, there is a need for a cleaning apparatus and method for cleaning and maintaining ducts that is not damaging.

Thus, while the foregoing body of prior art indicates it to be well known to use various forms of duct cleaning apparatuses, the provision of a simple and cost effective duct cleaning device and method of this invention is not contemplated. Nor does the prior art described above teach or suggest a simple, inexpensive, but effective apparatus for cleaning ductwork wherein a parachute means is used in conjunction with a safety retrieval line extended out of the exhaust outlet of the ductwork to guarantee deployment and retrieval.

A majority of the cleaning systems today are expensive truck mounted large capacity vacuum machines wherein a tube is partially extended into the duct from the outlet and sucked out using the vacuum until flow is achieved or improved and some debris removed. Smaller capacity vacuum systems are deployed inside a dwelling, at the dryer connection to the duct inlet, for example. A vacuuming tube is inserted part of the way into the duct at the inlet and vacuumed. With both approaches a middle section of the duct remains untouched by a cleaning brush.

The foregoing disadvantages are overcome by the novel duct cleaning apparatus of the present invention wherein a parachute means is added and used to guarantee cleaning of the entirety of the duct from the outlet to the inlet with an actual brush in contact with the sidewall as will be made apparent from the following description thereof.

Other advantages of the present invention over the prior art also will be rendered evident by the full description and specification of the preferred embodiment, to wit:

SUMMARY OF THE INVENTION

To achieve the foregoing and other advantages, the present invention, as briefly described, provides a duct brush with flexible bristles deployed using an inverted parachute means combined with a vacuum means for cleaning dryer ducts, air conditioning ducts, heating ducts and the like. The brush is made up of standard flexible bristles made of boar's hair or nylon, for example, connected to a flexible rope with a parachute structure attached to another end. The parachute part of the structure is constructed to open like an inverted umbrella when suction is applied for the purpose of threading a line A made of rope, chain, filament, or string, for example, through the pipe to be cleaned. Line A may also be advantageously made of a bungee-like cord to achieve an additional spring-like benefit from pulling line A in the event the brush becomes stuck after deployment. A line B is also connected to the brush and extended out of the outlet of the duct as a safety retrieval line. A vacuum is applied to the inside aperture of the pipe to be cleaned to suck the parachute open and to cause it to transit through the pipe to the inlet or inside aperture. Once this is accomplished the brush at the other end of the rope is pulled through to the inside aperture cleaning the pipe of occlusive matter inside the pipe.

The above brief description sets forth rather broadly the more important features of the present invention in order that the detailed description thereof may be better understood, and in order that the present contributions to the art may be better appreciated.

In this respect, before explaining a preferred embodiment of the invention in detail in conjunction with the drawings, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting. As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of this patent disclosure and description of the preferred embodiment of the novel invention is to enable the U.S. Patent and Trademark Office and the public generally, and especially the scientists, engineers and practitioners in the art who are not familiar with patent or legal terms of phraseology, to determine the nature of the novel invention quickly from a cursory inspection and the essence of the technical disclosure of the application. Accordingly, this patent disclosure is neither intended to limitingly define the invention or its application, which only is measured by the claims, nor is it intended to be limiting as to the scope of the invention in any way.

OBJECTS OF THE INVENTION

It is therefore an object of the present invention to provide a new and improved duct cleaning device that has all of the advantages of the prior art and none of the disadvantages.

It is another object of the present invention to provide a new and improved duct cleaning device, which may be easily and efficiently manufactured and marketed.

It is a further object of the present invention to provide a new and improved duct cleaning device, which is durable and reliable and easily constructed.

An even further object of the present invention is to provide a new and improved duct-cleaning device, which is susceptible to a low cost of manufacture with regard to both materials and labor, and which accordingly is then susceptible to low prices of sale to the consuming public, thereby making such a duct cleaning device available to the buying public or readily deployable by a home appliance service provider such as Sears™, for example.

Still yet a further object of the present invention is to provide a new and improved duct brush retrieval structure.

It is still a further object of the present invention to provide a new and improved duct brush, the size of which may be easily selected or adjusted to conform to the size of the duct being cleaned wherein a novel parachute means is added for deployment.

Still a further object of the present invention is to provide a new and improved duct brush including means for multiple brush passes by a serial connection of brush heads so that greater cleaning of the ductwork may be achieved with only one rope through pass using a parachute to thread a rope with multiple brush heads attached in series.

These together with still other objects of the invention, along with the various features of novelty which characterize the invention, are pointed out with particularity in this disclosure.

For a better understanding of the invention, its operating advantages and the specific objects attained by its uses, reference should be made to the accompanying drawings and descriptive matter in which there is illustrated a preferred embodiment of the invention.

DESCRIPTION OF THE PREFERRED EMBODIMENT

With reference to the drawings like numerals are assigned to the same parts in the different drawings wherein a new and improved duct brush apparatus and duct cleaning method and system embodying the principles and concepts of the present invention is described.

Figure 1:
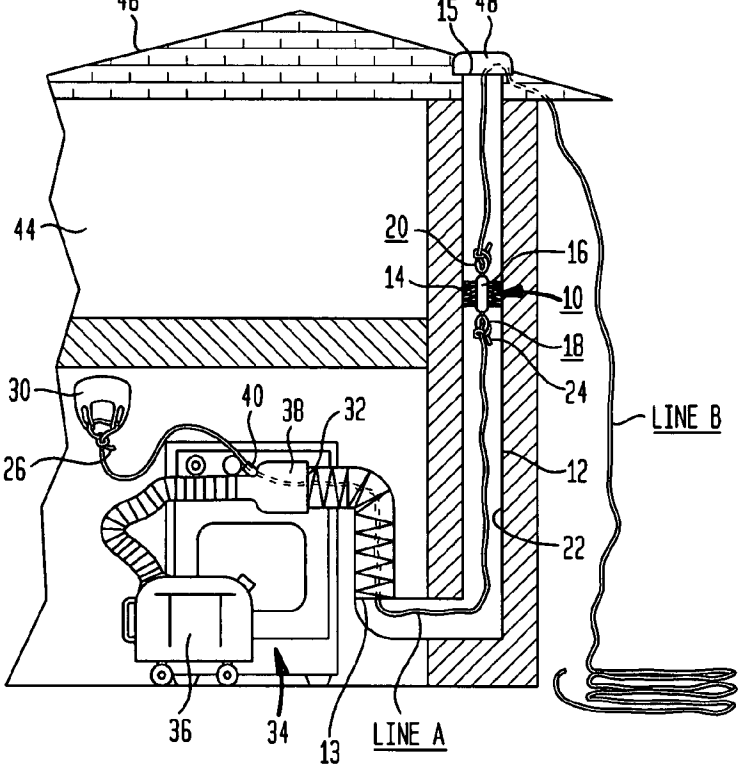
FIG. 1 shows a cross-sectional view of a part of a dwelling with a dryer, a vacuum machine, a dryer vent pipe, and the cleaning apparatus of the invention.

Referring initially to FIG. 1, a brush 10 is portrayed as it is positioned in a pipe 12 having an inlet 13, or vent or duct, for example. And, although the pipe 12 is illustrated in FIGS. 1 and 4 as having a round cross-section, it may comprise round, square, flexible, rectangular or other shaped cross-sections or a combination thereof.

Figure 4:
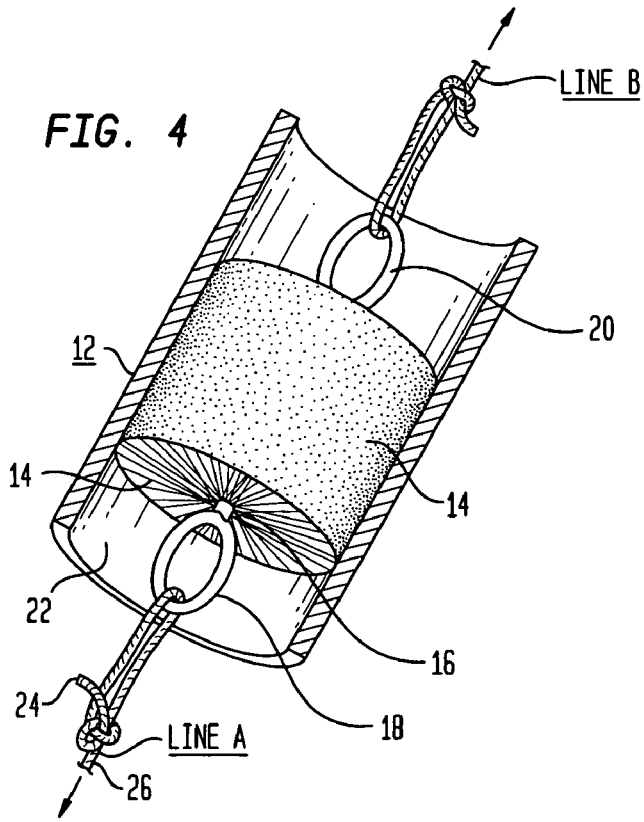
FIG. 4 is a cutaway perspective view of a vent cleaning brush with lines A and B attached inside a dryer vent pipe in accordance with the invention; and, FIG. 5 is a flow chart illustrating a selection of steps of the novel method of the invention.

Referring to FIGS. 1 and 4, the brush 10 has bristles 14 arranged radially, for example, around a core 16 that is cylindrical, for example, adapted to retain the bristles 14. The pipe 12 extends out of the roof at an outlet 15. The core 16 has a forward ring 18 or connecting means for connecting the brush 10 to a line A, for example, attached to one end of the core 16 and a rear ring 20 or connecting means for connecting the brush 10 to a line B, for example, attached to the other end of the core 16. The pipe 12 has an inside wall 22. The forward ring 18 and the rear ring 20 of the brush 10 are integrally connected to the core 16. The core 16 is shown located longitudinally in the pipe 12 with the bristles 14 frictionally engaging the inside wall 22 for cleaning same as the brush 10 moves along the pipe 12.

Figure 3:
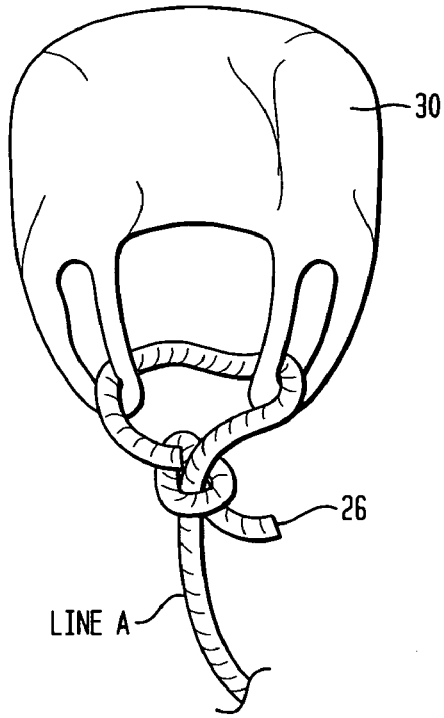
FIG. 3 is a perspective view of a parachute device in accordance with the invention.

As further shown in FIG. 1 and FIG. 4, line A having a first end 24 and a second end 26, is attached to the forward ring 18 via its first end 24 wherein a connecting knot is formed at the forward ring 18. The lines A and B are made of a line selected from the group consisting of rope, string, metal chain, or plastic filament, for example. As shown in FIG. 3, the second end 26 of the line A is attached by a knot, for example, to a transit means or transit device 30 that is parachute-like and has a diameter (measured transverse to the pull direction of the line A) greater than that of the pipe 12. In FIG. 1, the rear ring 20 is shown attached by a knot to another line B, made of rope or bungee-cord line, for example. The line B functions as a safety line for retrieval of the brush 10 in the event it becomes lodged in the pipe 12 during its descent when being pulled along and thru the pipe 12 comprised of multi-directional ductwork, for example, by line A.

Figure 2A:
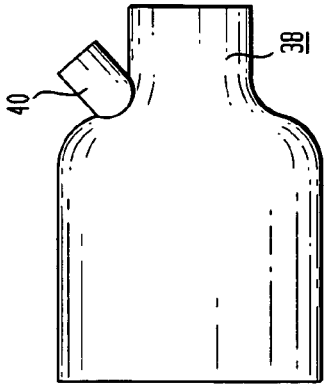
FIG. 2*a* is a side view of the novel adapter for connecting a vacuum machine and line to a dryer vent pipe.
Figure 2B:
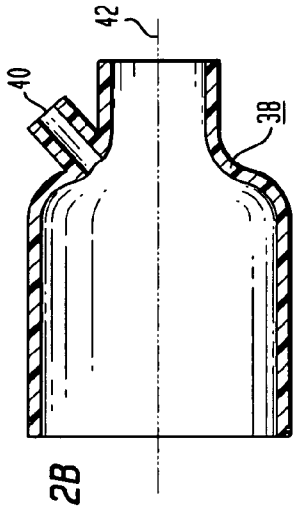
FIG. 2*b* is a cross-section of the novel adapter.
Figure 2C:
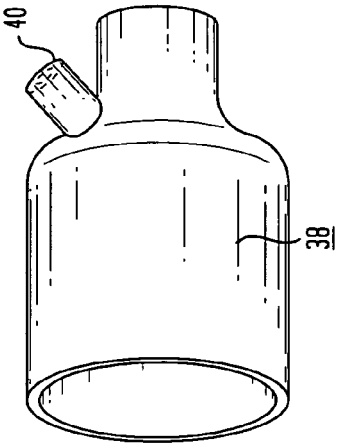
FIG. 2*c* is a perspective view of the novel adapter.

The device 30 shown in detail in FIG. 3 is adapted to be sucked through the pipe 12 to a juncture 32 that connects to a dryer 34. A sucking force is applied at the juncture 32 by a commercial vacuum machine 36 applied at the juncture 32. The sucking force pulls the device 30 to a vacuum adapter 38 shown in detail in FIGS. 2A, 2B, and 2C.

In practice, the device 30 usually transits the pipe 12 of most dwellings in less than 30 seconds. Transit time depends on the length of the pipe 12, the capacity of the vacuum machine 36, the drag between the surface of the device 30 and the inside of the pipe 12, the degree of occlusion anywhere in the pipe 12, the length of the pipe 12, and certain other minor factors known in the art. Once the device 30 reaches the adapter 38 it quickly accumulates there and stops there with the line A attached. The adapter 38 is then detached from the pipe 12 and the vacuum machine 36. Next, the device 36 is removed from the adapter 38 and detached from the line A. The line A is then threaded through a small aperture 40 transversely or obliquely oriented with respect to a central axis 42 for the adapter 38 as fully illustrated in FIG. 1 combined with FIGS. 2*a*, 2*b*, and 2*c*.

Again referring to FIG. 1 there is shown a partial cut-away view of a dwelling 44 with the pipe 12 extending outside a roof 46, for example, covering the dwelling 44. The pipe 12 comprises a dryer venting means to the outside of the dwelling 44. A vent cap 48 non-sealingly covers the pipe 12. In using the novel method the line B is optionally extended from the outside end of the pipe 12 as a backup or safety means for removing the brush 10 by pulling the line B.

In the initial trials and testing of the method and apparatus the device 30 comprised a kind of inverted parachute. The inventor discovered that device 30 functioned perfectly when it was comprised of a durable grocery plastic bag such as customarily used for bagging groceries in supermarkets, for example. The method of the invention has been commercially sold with significant commercial success using a money-back guarantee of an absolutely true representation that the entirety of the vent pipe will be cleaned from the outlet to inlet.

The inventor theorizes that the suction created at the juncture 32 caused by the vacuum machine 36 connected at the juncture 32 in place of the dryer 34, causes some of the air to fill the bag and expand the bag open like a parachute until it is limited only by the inside wall 22 of the pipe 12. For the lines A and B a medium diameter nylon rope is used. One end of rope comprising line A is used to securely tie the two handles of the plastic grocery bag together. The suction from the vacuum machine 36 moves the air filled grocery bag or parachute comprising the device 30 quickly through the pipe 12. The flexibility of the device 30 combined with the suction from a vacuum machine 36 and a restriction reduction in diameter of the adapter 38 causes the device 30 to collapse and constrain itself in the adapter 38 where it can be retrieved.

Hence, shown in FIG. 1 is a complete cleaning apparatus made up of a duct cleaning brush 10 with bristles 14 that is attached around a central spine 16. The bristles 14 are adapted by being shaped as the inside contour of the pipe 12 for cleaning inside 22 of the pipe 12, or duct, having the inlet 13 and the outlet 15. The apparatus has a first attachment means or ring 18 for attaching a first line or line A. The first attachment means or ring 18 is located at a forward end of the brush 10. A second attachment means or ring 20 is for attaching a second line or line B with a knot. The second attachment means or ring 20 is located at a rear end of the brush. The second line or line B is attached to the second attachment means or ring 20. The second line or line B has a secondary first end and a secondary second end outside the dwelling 44.

The first line or line A has a primary first end or end 24 and a primary second end or end 26. The primary first end or end 24 is attached to the first attachment means or ring 18. The primary second end of the line B extends out of the outlet 15. The secondary first end is attached to the second attachment means or ring 20. The second line or line B is a safety line to insure removal of the duct cleaning brush 10 in the event the duct cleaning brush 10 lodges in the duct or pipe 12.

Line A or the first line is a pulling line wherein the primary second end 26 is attached to a transit device 30, a detachable parachute-like means for deploying and moving the pulling line A. The device 30 is attached to the primary second end or end 24 of the pulling line or line A.

The adapter means or adapter 38 simultaneously receives the primary second end or end 26 of line A and a vacuum connection at the juncture 32. The adapter 38 interconnects the juncture 32 and the vacuum machine 36 and allows end 26 of line A to be pulled. The brush 10 with the line A attached makes up a movable duct cleaning means for cleaning the duct 12 by the brush 10 movably fitting inside the duct 10. The line A makes up a manipulating means for manipulating movement of the duct cleaning means or brush 10. The knot connection of the line A and ring 18 forms an attaching means for detachably attaching the manipulating means or line. The device 30 is a transport means detachably connected to the manipulating means or line A. Line A is flexible and substantially inelastic.

Figure 5:
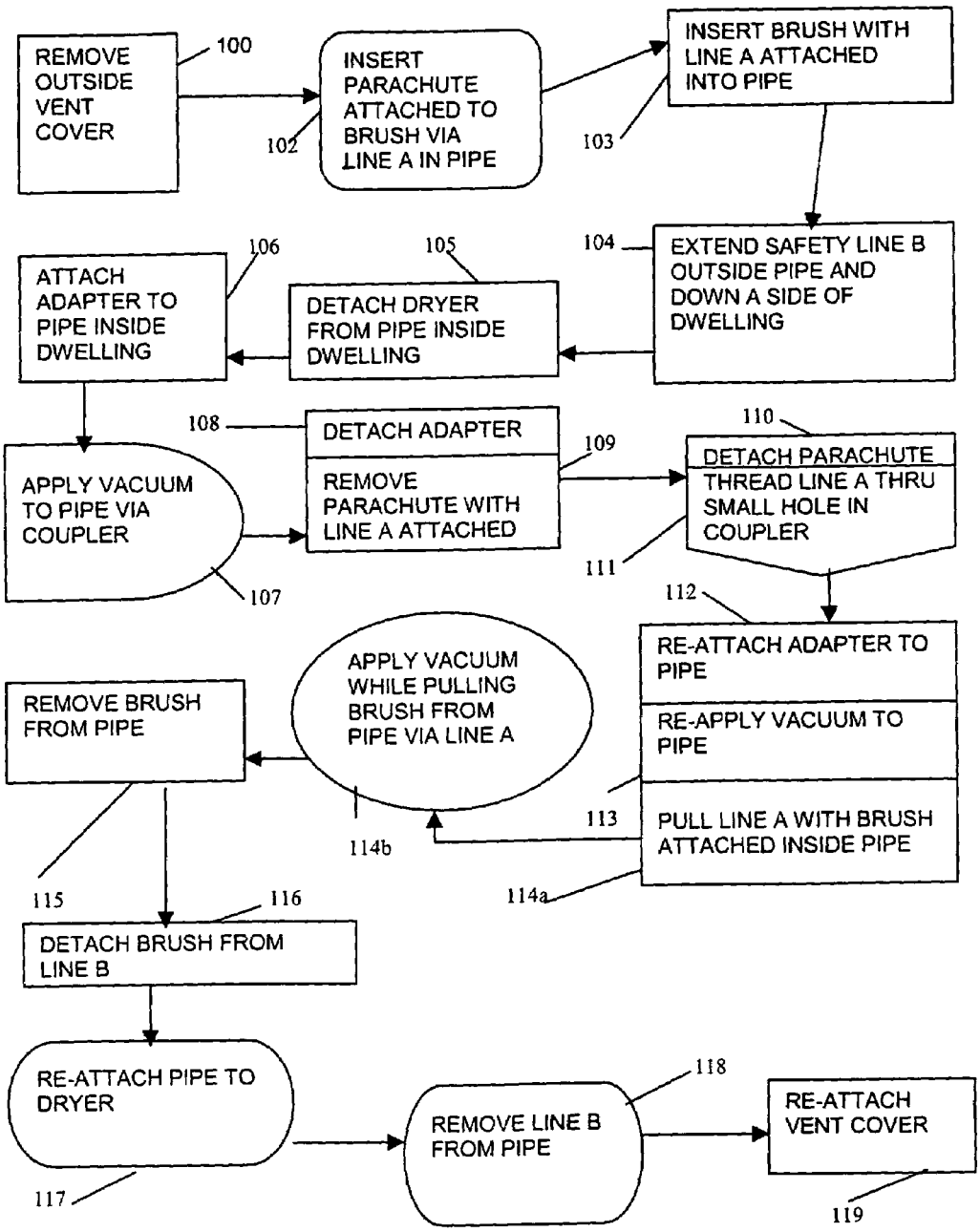

As illustrated in FIGS. 1 and 5, the next step in the novel method occurs by stopping the vacuum. Then, after the device 30 is removed the rope A may be pulled independently or threaded through a side vent or aperture 40 and the adapter 38 re-attached to the vacuum machine 36 and a vacuum or suction applied to the pipe 12 as the brush 10 is pulled down or along the pipe 12 by the line A.

As noted above and shown in detail in FIG. 4, the line B serves as a safety rope for retrieval of the brush 10 in the event the brush 10 is unable to fully navigate all of the turns of the pipe 12 or has to be changed to a different size diameter to fully traverse the entirety of the pipe 12 and/or to provide a means for administering a scrubbing action if needed to dislodge a stubborn occlusion, for example.

As evinced by the foregoing, as shown in FIG. 5, the novel method for cleaning the vent pipe 12 comprises the following steps: (step 100) Removing the outside vent cover 48 (in actuality, this is an optional step since oftentimes access to the pipe 12 can obtained and the brush and other required items inserted without removing the cover or there is no cover 48); (step 102) inserting a transit means such as a parachute, parachute-like plastic bag, or device 30 attached to the brush 10 via the line A, into the vent pipe 12; (step 103) inserting the brush 10 with the line A attached into the pipe 12; (step 104) extending the safety line B outside of the pipe 12 and down a side of the dwelling 44; (step 105) detaching or disconnecting a dryer 34 from its vent pipe 12 connection inside the dwelling 44; (step 106) attaching the adapter 38, a vacuum machine coupler, to the pipe 12 inside the dwelling 44; (step 107) applying a vacuum suction with a vacuum cleaner to the pipe 12 via the adapter 38 or coupler until the device 30 lodges inside or near enough to the adapter 38 to be manually retrieved; (step 108) detaching the adapter 38; (step 109) then, removing the device 30 with the line A attached; (step 110) then, detaching or removing the device 30 from the line A; (step 111) threading or extending the line A through an aperture 40 in the adapter 38; (step 112) re-attaching the adapter 38 to the inside end of the pipe 12; (step 113) re-applying suction to the pipe 12; (steps 114*a* and 114*b*) and simultaneously or concomitantly pulling line A with the brush 10 attached to the line A inside the pipe 12; (step 115) removing the brush 10 from the pipe 12; (step 116) disconnecting the line B from the brush 10; (step 117) re-attaching or interconnecting the pipe 12 to the dryer 34; (step 118) removing the line B from the pipe 12 (note: This step is optional as the line B can be pulled from the inside through the inlet 13); and, (step 119) re-attaching the vent cap 48 to the pipe 12 outside the dwelling 44. Again, step 119 is optional and required if and only if step 100 is implemented.

Thus, the method of the invention comprises a novel improvement in the prior methods for cleaning a duct in a dwelling. In all dwellings the duct has an inlet and an outlet separated by meters of virtually airtight interconnected lengths of duct extending in multiple directions inside the walls of the dwelling. However, each duct extends in the case of a clothes dryer from its air vent on the back of the dryer through a flexible duct to an inlet onto which the flexible accordion type duct is connected with a clamp. The duct vents hot air from the dryer from inside the dwelling to outside of the dwelling and usually becomes significantly and partially clogged from time to time requiring cleaning. However, the prior art usually partly cleans the duct. This partial cleaning extends from the inlet partially up the duct by brushing and vacuuming. Some cleaning services remove the outside vent cap and insert a brush from the outside to loosen debris and then vacuum. However, the prior art does not teach routinely cleaning and scrubbing the entire length of the duct from the inlet to the outlet.

The improved method comprising the additional step of passing a brush having a forward end and a rear end into the duct, the step of moving the brush inside the duct with a line A attached to the brush that extends through the entirety of the duct to the inlet. A transit means such as the device 30 combined attachment to the line A and then the step of applying a vacuum to the duct moves the transit means 30 through the duct 12 to the inlet 32, the improvement comprising the additional steps of: (a) attaching a safety line to an end of the brush; (b) extending the safety line out of the outlet to the outside of the dwelling; (c) attaching a pulling means to the brush for pulling the brush through the duct; (d) attaching a transit means for moving the pulling means through the duct to the inlet, the transit means being attached to the pulling means; and, (e) applying a vacuum means for generating a suction force sufficient to suck the transit means with the pulling means attached through the duct to the inlet; and, (f) extending the pulling means out of the inlet.

The invention having now been fully described, it should be understood that it may be embodied in other specific forms or variations without departing from its spirit or essential characteristics. Accordingly, the embodiments described above are to be considered in all respects as illustrative and not restrictive, the scope of the invention being indicated by the appended claims rather than the foregoing description, and all changes which come within the meaning and range of equivalency of the claims and/or the doctrine of equivalents is intended to be embraced therein.

| PARTS LIST | |
|---|---|
| brush | 10 |
| pipe | 12 |
| inlet | 13 |
| bristles | 14 |
| outlet | 15 |
| core | 16 |
| forward ring | 18 |
| rear ring | 20 |
| inside wall | 22 |
| line | A |
| first end | 24 |
| second end | 26 |
| device | 30 |
| line | B |
| juncture | 32 |
| dryer | 34 |
| vacuum machine | 36 |
| adapter | 38 |
| aperture | 40 |
| axis | 42 |
| dwelling | 44 |
| roof | 46 |
| vent cap | 48 |

What is claimed is:

1. In a method for cleaning a duct in a dwelling, the duct having an inlet and an outlet, the duct extending from inside the dwelling to outside of the dwelling, the method comprising a step of passing a brush having a forward end and a rear end into the duct, a step of moving the brush inside the duct, and then a step of applying a vacuum to the duct, the improvement comprising the additional steps of: attaching a safety line to an end of the brush and providing a transit means connected to another end of the brush; extending the safety line out of the outlet to the outside of the dwelling; attaching a pulling means connected to the brush for pulling the brush through the duct; attaching an adapter having a primary opening and a smaller secondary opening and a tertiary opening, the primary opening being connected to a vacuum means for generating a suction force, the secondary opening being detachably connected to the inlet; and, applying a vacuum means for generating a suction force sufficient to suck said pulling means to the adapter, the pulling means transiting through the duct to the inlet and then extending through the tertiary opening of the adapter; and, extending the pulling means out of the inlet through the tertiary opening in the adapter while simultaneously re-applying the suction force from said vacuum means to the inlet.

2. The method according to claim 1 wherein the transit means for moving the pulling means through the duct to the inlet is a flexible parachute-like structure impervious to air that is substantially the size and shape of a plastic grocery shopping bag with two like handles and wherein a first line is tied to the two handles.

3. In a method for cleaning a duct in a dwelling, the duct having an inlet and an outlet, the duct extending from inside the dwelling to outside of the dwelling, the method comprising a step of passing a cleaning brush having a forward end and a rear end into the duct, a step of moving the cleaning brush inside the duct, and then a step of applying a vacuum to the duct, the improvement comprising the additional steps of: attaching a safety line to an end of the cleaning brush; extending the safety line out of the outlet to the outside of the dwelling; attaching a pulling means for pulling the cleaning brush through the duct; attaching a transit means to the cleaning brush, the transit means being for moving the pulling means through the duct to the inlet; detachably connecting an adapter with three apertures, the adapter sealingly fitting over the inlet; and, applying a vacuum means for generating a suction force sufficient to suck the transit means with the pulling means attached through the duct to the inlet; and then retrieving the transit means via one of the apertures and detaching the transit means from the pulling means; extending the pulling means out of the inlet; interposing the adapter between the vacuum means and the inlet, the adapter having at least first, second, and third apertures, the vacuum means being sealingly connected to the first aperture; the inlet being detachably sealingly connected to the second aperture; the pulling means being slidably extended through the third aperture, the third aperture being substantially smaller than the first and second apertures; and, simultaneously operating the pulling means while simultaneously re-applying suction from the vacuum means through the first aperture to the inlet.

4. The method according to claim 3 wherein the duct has a wall, the wall being continuous and sealed from the inlet to the outlet.

5. The method according to claim 4 wherein the pulling means is a cord or rope having a diameter substantially equal to the diameter of the third aperture whereby suction around the pulling means is diminished.

6. The method according to claim 5 wherein vacuum means has a vacuum hose that is detachably connected to the first aperture of the adapter.

7. The method according to claim 6 wherein the adapter is made of a flexible material and the third aperture is located at the end of a cylindrical extension from the adapter.

8. The method according to claim 7 wherein the pulling means is a first line and wherein the transit means for moving the pulling means through the duct to the inlet is a flexible parachute-like structure that is substantially the size and shape of a plastic grocery shopping bag with two like handles and wherein the first line is attached to the two handles.

9. The method according to claim 8 wherein the first line is detachably tied to the two handles.

10. The method according to claim 9 wherein the first line is an elongated flexible structure such as rope, cord, wire or string.

11. The method according to claim 10 wherein the safety line is comprised of at least two lengths detachably joined together.

12. The method according to claim 11 wherein the cleaning brush comprising an eyelet at each end.

13. The method according to claim 1 wherein the transit means for moving the pulling means through the duct to the inlet is a plastic bag impervious to air with two handles and of a size sufficient to overfill the diameter of the dryer vent pipe.

* * * * *